US007309827B2

(12) United States Patent
Sakurada

(10) Patent No.: US 7,309,827 B2
(45) Date of Patent: Dec. 18, 2007

(54) ELECTRONIC MUSICAL INSTRUMENT

(75) Inventor: Shinya Sakurada, Hamamatsu (JP)

(73) Assignee: Yamaha Corporation (JP)

( * ) Notice: Subject to any disclaimer, the term of this patent is extended or adjusted under 35 U.S.C. 154(b) by 234 days.

(21) Appl. No.: 10/903,256

(22) Filed: Jul. 30, 2004

(65) Prior Publication Data

US 2005/0056139 A1 Mar. 17, 2005

(30) Foreign Application Priority Data

Jul. 30, 2003 (JP) ..... 2003-203680
May 14, 2004 (JP) ..... 2004-144792

(51) Int. Cl.
*G10H 7/00* (2006.01)
*G10H 1/00* (2006.01)

(52) U.S. Cl. ..... 84/616; 84/464 A; 84/477 R; 84/485 R; 84/600; 84/603; 84/609; 84/610; 84/654; 704/207

(58) Field of Classification Search ..... 84/616, 84/485 R, 654, 609, 600, 464 A, 610, 603, 84/477 R
See application file for complete search history.

(56) References Cited

U.S. PATENT DOCUMENTS 4,038,895 A * 8/1977 Clement et al. ..... 84/687
4,463,650 A * 8/1984 Rupert ..... 84/654
4,633,748 A * 1/1987 Takashima et al. ..... 84/603
4,685,373 A * 8/1987 Novo ..... 84/464 A
4,703,681 A * 11/1987 Okamoto ..... 84/478
4,771,671 A * 9/1988 Hoff, Jr. ..... 84/645
4,915,001 A * 4/1990 Dillard ..... 84/600
4,958,552 A * 9/1990 Minamitaka et al. ..... 84/603
5,018,428 A * 5/1991 Uchiyama et al. ..... 84/616
5,069,105 A * 12/1991 Iba et al. ..... 84/605
5,278,346 A * 1/1994 Yamaguchi ..... 84/609
5,298,678 A * 3/1994 Higashi ..... 84/659
5,504,269 A * 4/1996 Nagahama ..... 84/609
5,554,813 A * 9/1996 Kakishita ..... 84/622
5,770,813 A * 6/1998 Nakamura ..... 84/610
5,942,709 A * 8/1999 Szalay ..... 84/616

(Continued)

FOREIGN PATENT DOCUMENTS

GB 1393542 2/1972

(Continued)

OTHER PUBLICATIONS

U.S. Appl. No. 10/746,316, filed Dec. 2003, Sakurada.

(Continued)

*Primary Examiner*—Lincoln Donovan
*Assistant Examiner*—Christina Russell
(74) *Attorney, Agent, or Firm*—Rossi, Kimms & McDowell, LLP

(57) ABSTRACT

An electronic musical instrument provides a player with an assisted performance to offer him/her the pleasure of performing on a musical instrument, and to help him/her in practicing the electronic musical instrument on which a tone pitch of a musical tone to be generated is determined in accordance with the operation of a combination of performance operators, as in the case of a wind instrument such as a trumpet. A number of operating modes are provided to allow the player to independently practice their ability with respect to one or more performance operators or to simply play the electronic musical instrument without an assisted performance.

25 Claims, 5 Drawing Sheets

U.S. PATENT DOCUMENTS

| | | | | |
|---|---|---|---|---|
| 5,986,199 | A * | 11/1999 | Peevers | 84/603 |
| 6,002,080 | A * | 12/1999 | Tanaka | 84/615 |
| 6,011,210 | A * | 1/2000 | Haruyama et al. | 84/470 R |
| 6,025,551 | A * | 2/2000 | Munekawa et al. | 84/477 R |
| 6,124,544 | A * | 9/2000 | Alexander et al. | 84/616 |
| 6,211,452 | B1 * | 4/2001 | Haruyama | 84/477 R |
| 6,369,311 | B1 * | 4/2002 | Iwamoto | 84/615 |
| 6,372,973 | B1 * | 4/2002 | Schneider | 84/609 |
| 6,515,211 | B2 * | 2/2003 | Umezawa et al. | 84/477 R |
| 6,555,737 | B2 * | 4/2003 | Miyaki et al. | 84/477 R |
| 6,653,546 | B2 * | 11/2003 | Jameson | 84/735 |
| 6,657,114 | B2 * | 12/2003 | Iwamoto | 84/610 |
| 6,703,549 | B1 * | 3/2004 | Nishimoto et al. | 84/609 |
| 6,815,599 | B2 * | 11/2004 | Asahi | 84/485 R |
| 6,816,833 | B1 * | 11/2004 | Iwamoto et al. | 704/207 |
| 6,881,890 | B2 * | 4/2005 | Sakurada | 84/654 |
| 6,911,591 | B2 * | 6/2005 | Akazawa et al. | 84/616 |
| 6,992,245 | B2 * | 1/2006 | Kenmochi et al. | 84/622 |
| 2001/0037196 | A1 * | 11/2001 | Iwamoto | 704/207 |
| 2003/0177892 | A1 * | 9/2003 | Akazawa et al. | 84/616 |
| 2003/0209131 | A1 * | 11/2003 | Asahi | 84/485 R |
| 2004/0144239 | A1 * | 7/2004 | Sakurada | 84/616 |
| 2005/0076774 | A1 * | 4/2005 | Sakurada | 84/616 |

FOREIGN PATENT DOCUMENTS

| | | | |
|---|---|---|---|
| JP | 2003-91285 | A | 3/2003 |
| WO | WO 00/72303 | A1 | 11/2000 |

OTHER PUBLICATIONS

U.S. Appl. No. 10/903,246, filed Jul. 2004, Sakurada.

* cited by examiner

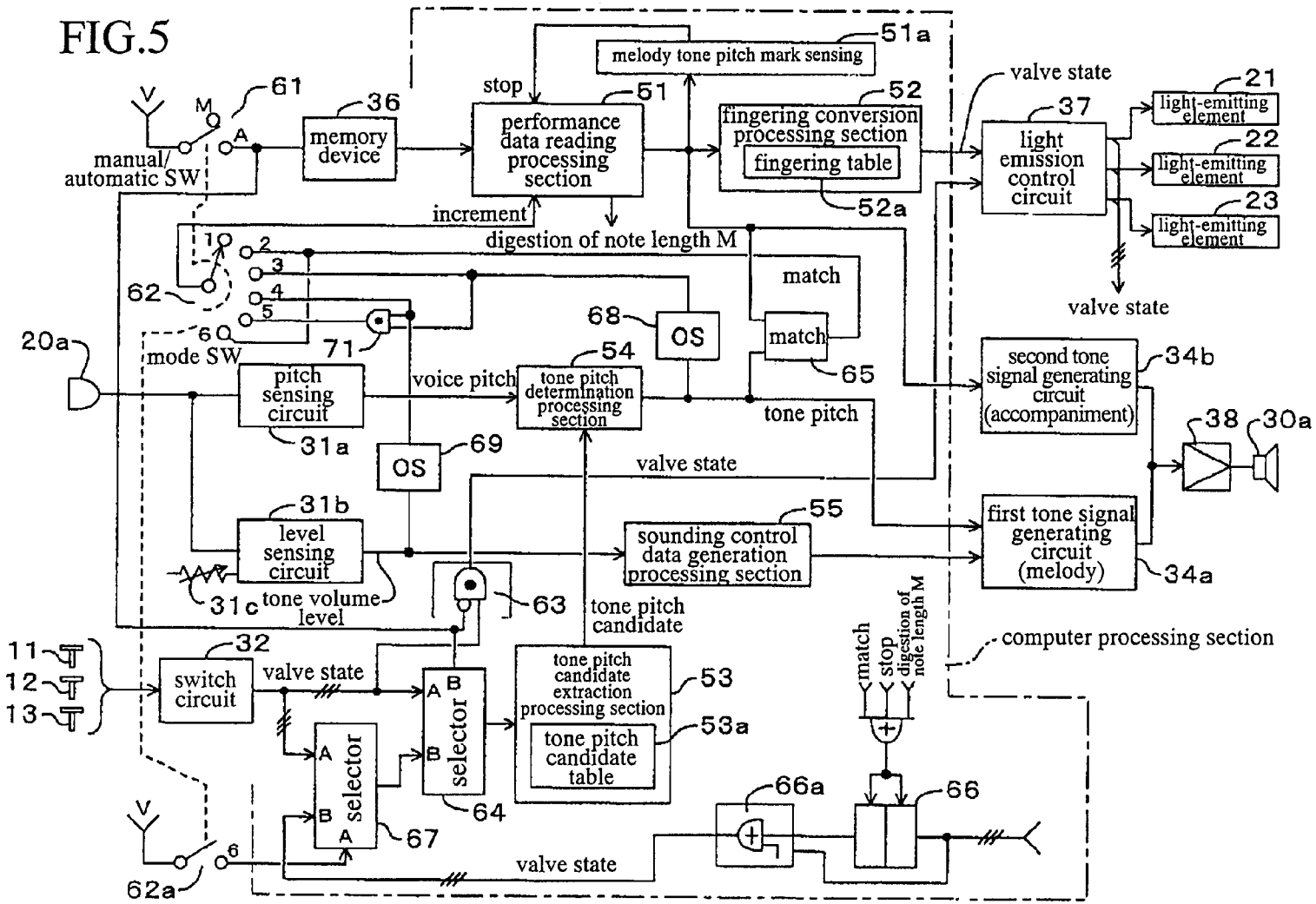
FIG.5
manual/automatic SW
memory device
performance data reading processing section
melody tone pitch mark sensing
fingering conversion processing section
fingering table
light emission control circuit
light-emitting element
light-emitting element
light-emitting element
valve state
stop
increment
digestion of note length M
match
match
tone pitch
voice pitch
tone pitch determination processing section
OS
OS
pitch sensing circuit
level sensing circuit
tone volume level
mode SW
second tone signal generating circuit (accompaniment)
first tone signal generating circuit (melody)
sounding control data generation processing section
computer processing section
tone pitch candidate
tone pitch candidate extraction processing section
tone pitch candidate table
selector
selector
switch circuit
match
stop
digestion of note length M

FIG.6

| | |
|---|---|
| ⋮ | |
| melody tone pitch mark | melody tone pitch |
| melody note length mark | melody note length |
| accompaniment tone pitch mark | accompaniment tone pitch |
| accompaniment tone pitch mark | accompaniment tone pitch |
| accompaniment note length mark | accompaniment note length |
| melody tone pitch mark | melody tone pitch |
| melody note length mark | melody note length |
| ⋮ | |

ELECTRONIC MUSICAL INSTRUMENT

BACKGROUND OF THE INVENTION

1. Field of the Invention

The present invention relates to an electronic musical instrument obtained by electronically configuring an acoustic musical instrument having a plurality of performance operators for determining a tone pitch of a musical tone to be generated in accordance with a combination of operation of the plurality of performance operators, for example, like a wind instrument such as a trumpet, horn, euphonium or tuba.

2. Description of the Related Art

Conventionally, on the above-described wind instruments, a tone pitch of a musical tone is determined in accordance with two input operations of an input operation on three or four valves and an embouchure input operation. However, it is quite difficult for a rank beginner to successfully produce a musical tone by conducting these two input operations on such wind instruments. In particular, the embouchure input operation is difficult for beginners. Even if the beginner has succeeded in generating a tone, he/she still has a hurdle to overcome before completing a musical piece. More specifically, since a scale (in particular, a series of overtone pitches) is determined in accordance with a combination of the three valve operations, and a tone pitch is determined in accordance with a combination of an embouchure input operation and the valve operations, various different tone pitches can be produced by a combination of valve operations. Therefore, the present applicant has disclosed a performance controller used as an apparatus for practicing such wind instruments (Japanese Laid-Open No. 2003-91285A).

The performance controller disclosed in Japanese Laid-Open No. 2003-91285A has only overcome the difficulty of the embouchure operation and is still susceptible to improvement as a trainer for beginning players. Playing a musical instrument such as a trumpet, horn, euphonium and tuba on which a tone is determined by a fingering combination is difficult because a combination of depressing operations on three or four valves results in a plurality of possible tone pitches. That is, compared to instruments such as keyboard instruments on which an individual tone pitch is determined by an individual key, acquiring skills to play a wind instrument smoothly is more difficult. As a result, beginning players cannot readily play a musical instrument on which a tone is determined by a fingering combination, having difficulty even in finding where to start with in practicing the instrument.

SUMMARY OF THE INVENTION

The present invention was accomplished to solve the above-described problem, and an object thereof is to provide an electronic musical instrument in which the tone pitch of a musical tone to be generated is determined in accordance with the combination of operation of a plurality of performance operators, the electronic musical instrument, in particular, providing a beginner with an assisted performance of a musical piece, offering the beginner the pleasure of performing on a musical instrument, and helping him/her find where to start with in practicing the instrument.

It is a feature of the present invention for solving the above-described problem to provide a musical instrument having a plurality of performance operators and an oral input section for inputting a signal containing a pitch generated by a user's mouth, the musical instrument being capable of generating a musical tone in accordance with a combination of operation of the plurality of performance operators and the pitch contained in the signal input to the oral input section, the musical instrument comprising an ancillary performance section for sequentially outputting first performance data representative of a tone pitch of a musical tone; a combination information producing section for automatically producing, on the basis of the first performance data sequentially output from the ancillary performance section, information on a combination of the plurality of performance operators to be operated in order to designate a tone pitch represented by the first performance data; a pitch information sensing section for sensing pitch information on a pitch on the basis of a signal input to the oral input section; and a tone pitch determination section for determining a tone pitch of a musical tone to be generated on the basis of the produced combination information and the sensed pitch information. In this case, the plurality of performance operators are operated, for example, with a hand. Further, the musical instrument has a shape of a wind instrument.

This feature allows the musical instrument to generate a musical tone substantially only on the basis of information on a pitch that is contained in a signal input to the oral input section. In other words, due to the feature, the musical instrument can proceed with the performance of a musical piece only on the basis of the pitch information. Therefore, the musical instrument can provide a player with an assisted performance of a musical piece and training toward a complete performance on a musical instrument on which a tone is determined by a fingering combination such as a trumpet, horn, euphonium and tuba as long as the player knows the musical piece and orally inputs (or sings) the melody of the musical piece.

Another feature of the present invention lies in that the musical instrument further includes a performance data output control section for determining whether the tone pitch determined by the tone pitch determination section matches the tone pitch represented by the first performance data output from the ancillary performance section, and controlling, when a match is determined, the ancillary performance section so that the ancillary performance section outputs succeeding first performance data.

This feature allows the player to control the performance in accordance with his/her intention to proceed the performance (the tempo of the performance and the timing to generate a tone are decided by the player). Different from a toy on which a user merely orally inputs (or sings) the melody of the musical piece to generate tones of a musical instrument, in other words, the musical instrument of the present invention does not allow to proceed with the performance when the player orally inputs a pitch tone corresponding to wrong tone pitch data. Therefore, the musical instrument of the present invention is effective at assisting only players having the intention to improve their skills.

A further feature of the present invention lies in that the tone pitch determination section has a capability of determining on the basis of a relation between the produced combination information and the sensed pitch information whether a musical tone corresponding to a signal input to the oral input section should be generated, and determines, only when it is determined that the musical tone should be generated, a tone pitch of the musical tone to be generated in accordance with the produced combination information and the sensed pitch information; and the musical instrument further comprises a performance data output control section for controlling, only when it is determined that the musical tone should be generated, the ancillary performance section so that the ancillary performance section outputs succeeding first performance data.

This feature allows the player to proceed with the performance when the pitch information generated by the player's mouth is accurate enough to generate a musical tone. When the pitch information generated by the player's mouth is too inaccurate to generate a musical tone, on the other hand, this feature stops the player from proceeding with the performance. In such a case, if the player modifies the pitch information generated by the player's mouth to input right pitch information, the player is allowed to proceed with the performance. As a result, such a repetitive training produces a high degree of effectiveness in practicing a musical instrument.

Still a further feature of the present invention lies in that the musical instrument further includes a performance data output control section for controlling, when the level of a signal input to the oral input section is equal to or above a given level, the ancillary performance section so that the ancillary performance section outputs succeeding first performance data. This feature allows the player to proceed with the performance as long as he/she has input to the oral input section a signal having a level equal to or above a given level even in a case where the pitch information generated by his/her mouth is wrong. Due to this feature, even a beginner can follow through with the practice in playing the instrument without getting tired of the practice. Since the performance will not be suspended due to this feature, in addition, this musical instrument is suitable for a case where the player practices on the musical instrument with other player.

An additional feature of the present invention lies in that the ancillary performance section has a capability of outputting second performance data that is different from the first performance data in interlocked relation with the first performance data and generating a musical tone corresponding to the second performance data. In this case, for example, the first performance data represents a melody tone, while the second performance data represents an accompaniment tone. This feature allows the player to practice playing a musical piece while listening to the accompaniment tones.

An even further feature of the present invention lies in that the musical instrument further includes a performance guiding section for showing a user a combination of the plurality of performance operators to be operated by use of first performance data output from the ancillary performance section. In this case, for example, the performance guiding section includes a plurality of light emitting devices for showing a user the performance operators to be operated by light emission of a neighborhood of each of the plurality of performance operators. This feature enables the player to master a combination of operation of the performance operators at every step (at every note) of the performance. If the player practices operating the performance operators as well as observes the performance operators, this feature produces a high degree of effectiveness in practicing a musical instrument.

A further feature of the present invention lies in that the musical instrument further includes an ancillary performance section for sequentially outputting first performance data representative of a tone pitch of a musical tone; a pitch information sensing section for sensing pitch information on a pitch on the basis of a signal input to the oral input section; a tone pitch determination section for determining a tone pitch of a musical tone to be generated on the basis of the combination of an operated performance operator among the plurality of performance operators and the sensed pitch information; and a performance data output control section for controlling, on the basis of the tone pitch determined by the tone pitch determination section and the tone pitch represented by the first performance data output from the ancillary performance section, the ancillary performance section so that the ancillary performance section outputs succeeding first performance data. Due to this feature, the progression of the performance is controlled in accordance with the pitch information included in the signal input to the oral input section and the combination of operation of the performance operators. Therefore, the musical instrument can provide a player with a further sophisticated assisted performance of a musical piece and training toward a complete performance on a musical instrument on which a tone is determined by a fingering combination such as a trumpet.

The present invention may be embodied not only as an invention of a musical instrument but also as an invention of a method of generating a musical tone.

BRIEF DESCRIPTION OF THE DRAWINGS

FIG. 5 is a functional block diagram according to the embodiment of the present invention; and FIG. 6 is a diagram showing a format of automatic performance data according to the embodiment of the present invention.

DESCRIPTION OF THE PREFERRED EMBODIMENT

Figure 1:
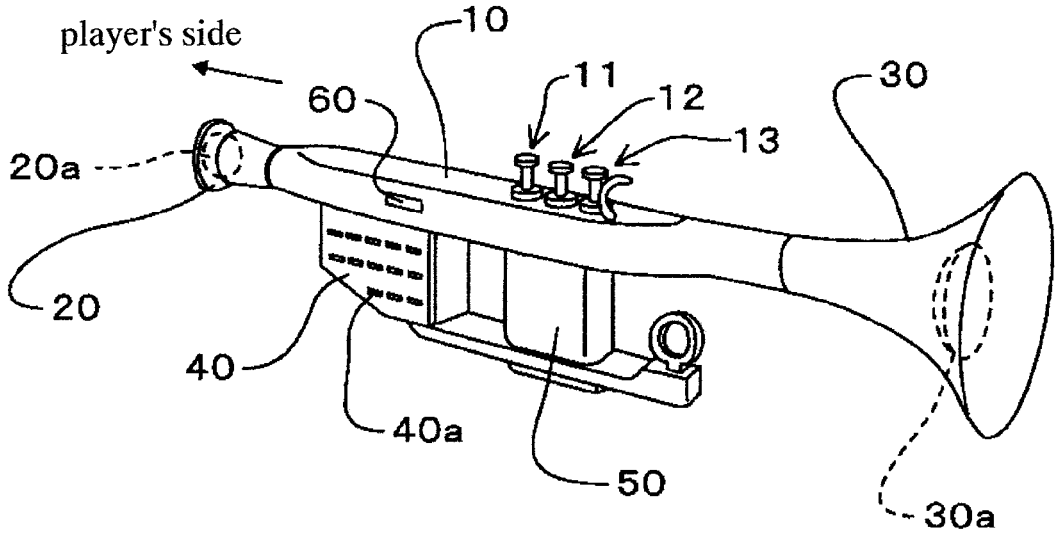
FIG. 1 is an external view of an electronic musical instrument according to an embodiment of the present invention.

FIG. 1 is an external view of an electronic musical instrument according to an embodiment of the present invention. The electronic musical instrument, which is in the shape of a trumpet, is provided with an oral input section 20 that corresponds to a mouthpiece. The oral input section 20 is provided at the end of a body 10, namely, the end facing a player. Provided at the opposite end of the body 10 is a tone emitting section 30 that corresponds to a bell. At the lower part of the body 10 there are provided an operating section 40 and a grasping section 50. In the midsection of the body 10 there are provided a first valve operator 11, second valve operator 12 and third valve operator 13 which are arranged in this order viewed from the oral input section 20. The first to third valve operators 11 to 13 correspond to piston valves (and keys) of a trumpet, corresponding to "a plurality of performance operators" described in the present invention.

Inside the oral input section 20 there is provided a vibration sensor 20*a* which senses vibrations of air such as a microphone which senses player's voice or a piezoelectric element bonded to a thin plate. Inside the tone emitting section 30 there is provided a speaker 30*a* for emitting musical tones. Further, the operating section 40 is provided with various setting operators 40*a* for switching between modes which will be described later. Inside the body 10 an electronic circuit device for controlling the operation of this musical instrument is housed. In addition, on the side of the body 10 a displayer 60 for displaying various operation modes is provided.

Figure 2:
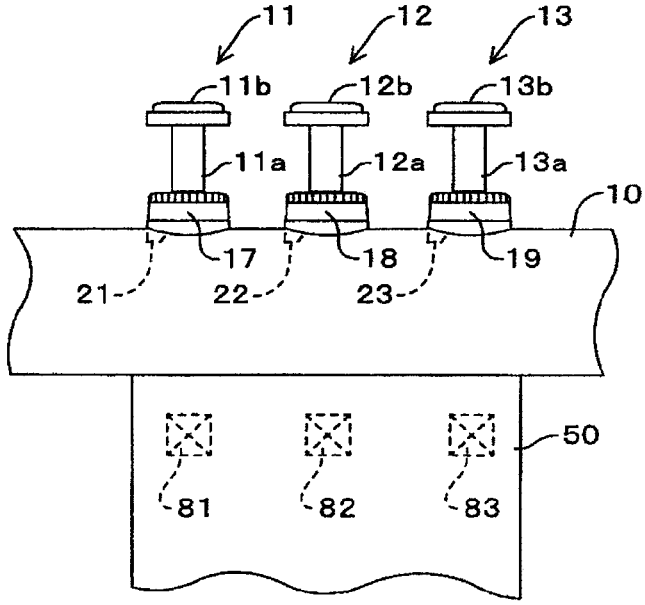
FIG. 2 is a drawing which illustrates the details of valve operators of the electronic musical instrument according to the embodiment of the present invention.

FIG. 2 illustrates the valve operators 11 to 13 in detail. The valve operators 11 to 13 respectively include rods 11*a* to 13*a* extended in the up-and-down direction and disk-shaped operating sections 11*b* to 13*b* that are fixed on the upper end of the rods 11*a* to 13*a* for being pressed and operated by a finger. The rods 11*a* to 13*a* are inserted into the body 10 and grasping section 50 in such a manner that respective rods 11*a* to 13*a* can be raised and lowered. The lower end parts of the rods 11*a* to 13*a* are each urged upward by a spring and stopper mechanism (not illustrated) disposed in the grasping section 50. When the valve operators 11 to 13 are pressed downward, the rods 11*a* to 13*a* are lowered into the body 10 to turn on a switch which is not illustrated. When the downward pressing is released, the rods 11 to 13*a* come to a standstill at the illustrated upper end position to turn off the switch.

At the circumference of the insertion inlets into the body 10 of the rods 11*a* to 13*a*, rings 17 to 19 are fixed, respectively. Under the rings 17 to 19, light-emitting elements 21 to 23 constructed with a light-emitting diode, a lamp, or the like are incorporated in the body 10 so as to correspond to the rings 17 to 19, respectively. The lower part of each of the rings 17 to 19 is formed with a transparent resin. This prevents the light emitted by energization of the light-emitting elements 21 to 23 from leaking through the upper surface of the rings 17 to 19, so that the whole rings 17 to 19 may emit light, each independently.

Figure 3:
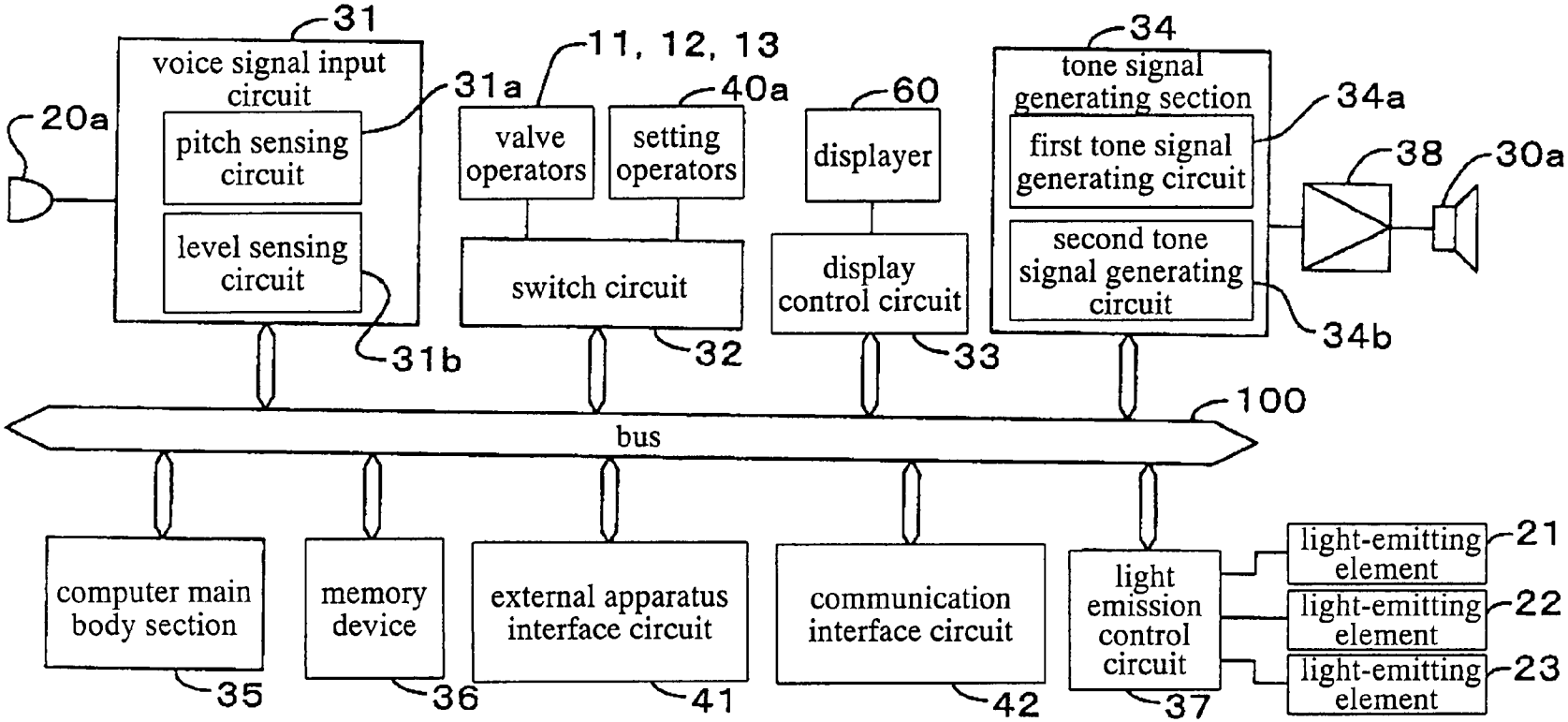
FIG. 3 is a functional block diagram of an electronic circuit device according to the embodiment of the present invention.

FIG. 3 is a functional block diagram of an electronic circuit device according to the embodiment. The electronic circuit device includes a voice signal input circuit 31, a switch circuit 32, a display control circuit 33, a tone signal generating section 34, a computer main body section 35, a memory device 36, and a light emission control circuit 37 that are connected to a bus 100.

The voice signal input circuit 31 includes a pitch sensing circuit 31*a* for sensing the pitch (frequency) of a voice signal that is input from a vibration sensor 20*a*, and a level sensing circuit 31*b* for sensing the tone volume level (amplitude envelope) of the voice signal. The switch circuit 32 has switches that are interlocked with an operation of the first to third valve operators 11 to 13 and the plurality of setting operators 40*a*, and senses the operation of the first to third valve operators 11 to 13 and the setting operators 40*a*. The display control circuit 33 controls the display state of the displayer 60. The tone signal generating section 34 is a circuit which generates tone signals on the basis of tone pitch data, key-on data, and key-off data that is input from the computer main body section 35. The tone signal generating section 34 is configured by a first tone signal generating circuit 34*a* which generates tone signals corresponding to melody tones and a second tone signal generating circuit 34*b* which generates tone signals corresponding to accompaniment tones. These tone signals are output to the speaker 30*a* via an amplifier 38. Here, the tone pitch data represents the frequency (pitch) of the generated musical tone, while the key-on data and key-off data represents the start and end of the generation of a musical tone, respectively.

The computer main body section 35 is composed of a CPU, a ROM, a RAM, a timer, and others, and controls various operations of this electronic musical instrument by execution of a program. The memory device 36 is provided with a recording medium having a small size and a relatively large capacity, such as a memory card, and stores various programs and various performance data. The performance data constitutes automatic performance data of music that stores tone pitch data, key-on data, key-off data, and others in time series. The light emission control circuit 37 controls energization of the light-emitting elements 21, 22 and 23.

Further, an external apparatus interface circuit 41 and a communication interface circuit 42 are also connected to the bus 100. The external apparatus interface circuit 41 communicates with various external music apparatus connected to a connection terminal (not illustrated) so as to enable output and input of various programs and data to and from various external music apparatus. The communication interface circuit 42 communicates with outside via a communication network (for example, the Internet) connected to a connection terminal (not illustrated) so as to enable output and input of various programs and data to and from outside (for example, a server).

Brief description of a method of playing this musical instrument will be given hereafter. A player holds the musical instrument by gripping the grasping section 50 with one hand, and operates to press the first to third valve operators 11 to 13 with the fingers of the other hand. This operation designates the tone pitch of musical tones. In this musical instrument, in the same manner as in a trumpet or the like, a combination of a non-operated state and an operated state of the first to third valve operators 11 to 13 simultaneously designates not one but a plurality of tone pitch candidates. Then, in a state in which the first to third valve operators 11 to 13 are operated in a desired combination, the player generates, toward the oral input section 20, a voice having a frequency that is close to the pitch (the frequency) of the musical tone that the player wishes to generate. The voice in this case may be, for example, a simple one such as "aah" or "uuh" and, in essence, it is sufficient that the voice has a specific frequency (hereinafter, referred to as "voice pitch"). By the generation of this voice, the tone pitch having the closest frequency to the input voice pitch is determined, as a tone pitch of the generated musical tone or an input tone pitch according to a mode described later, from among the plurality of tone pitch candidates designated by the aforesaid operation of the first to third valve operators 11 to 13. Then, according to the determined tone pitch, a musical tone (for example, a trumpet sound) or a musical tone in accordance with automatic performance data is generated in synchronization with the input voice.

Figure 4:
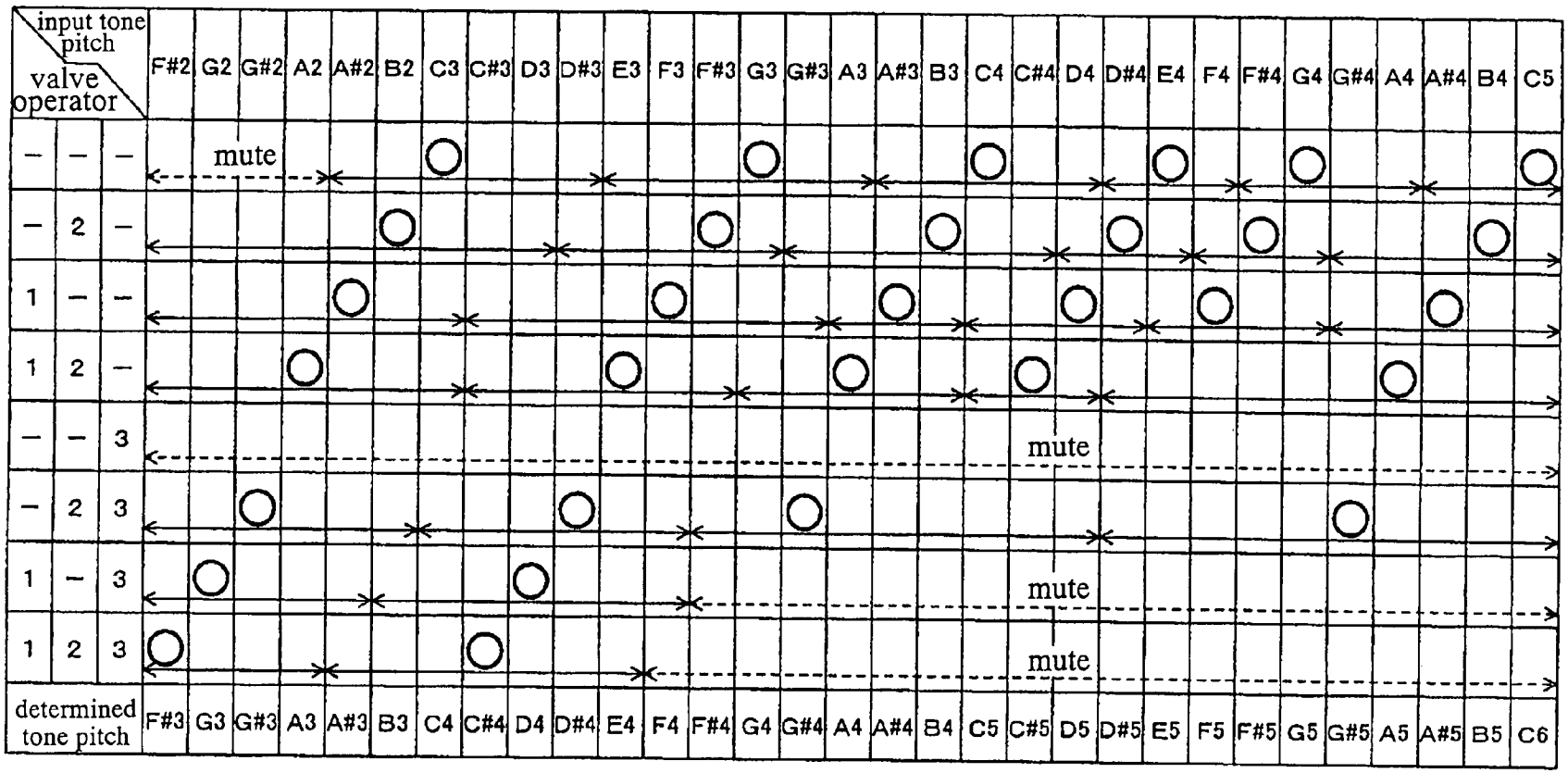
FIG. 4 is a fingering view showing a relationship between tone pitch and fingering according to the embodiment of the present invention.

The determination of a tone pitch will be concretely described with reference to FIG. 4. FIG. 4 is a fingering view showing a relationship between tone pitch and fingering (combinations of an operated state). The left column captioned with "valve operator" in FIG. 4 displays eight combinations of operation of the first to third valve operators 11 to 13 composed of the non-operated state and the operated state of the first to third valve operators 11 to 13 in the vertical direction. In this case, numerals "1", "2", and "3" denote valve operators that should be operated, in respective correspondence with the first, second, and third valve operators 11 to 13, and the symbol "–" denotes a valve operator that should not be operated. On the other hand, the bottom row captioned with "determined tone pitch" in FIG. 4 displays the tone names of the musical tones to be determined for the generation of musical tones, in the lateral direction.

Further, the symbol "o" at an intersection above the "determined tone pitch" and to the right of "valve operator"

provides correspondence between the tone pitch of the musical tone to be determined and the combination of the first to third valve operators 11 to 13 that should be operated. Therefore, by a combination of operation of the first to third valve operators 11 to 13, a plurality of tone pitches are designated as tone pitch candidates of the musical tone to be determined. For example, if none of the first to third valve operators 11 to 13 are operated, the tone pitch candidates of the musical tone to be determined will be "C4", "G4", "C5", "E5", "G5" and "C6". If only the second valve operator 12 is operated, the tone pitch candidates will be "B3", "F#4", "B4", "D#5", "F#5", and "B5".

Further, an arrow below the symbol "o" in FIG. 4 displays an allowance range of the shifts of the voice pitch that is input from the oral input section 20. This allowance range corresponds to the frequencies of the tone names displayed in the lateral direction in the top row captioned with "input tone pitch" in FIG. 4. Here, the tone names of the "determined tone pitch" in the bottom row in FIG. 4 are shifted from the tone names of the "input tone pitch" in the top row in FIG. 4 by one octave in order to compensate for the shift of the generated tone pitch range of a trumpet from the voice pitch range of a human voice (male). Further, the denotation "mute" in FIG. 4 means that no musical tones are determined (or generated). Therefore, if for example a voice in a frequency range between "A#2" and "D#3" is input in a state in which none of the first to third valve operators 11 to 13 are operated, a tone pitch of "C4" is determined, while if a voice in a frequency range between "E3" and "A3" is generated in a state in which none of the first to third valve operators 11 to 13 are operated, a tone pitch of "G4" is determined. Here, the allowance ranges of the shift of the frequency of the voice signal can be changed in various ways by an operation of the setting operators 40*a*.

Next, specific operations of the electronic musical instrument according to the embodiment will be described with reference to the functional block diagram of FIG. 5. Here, the computer processing section in this functional block diagram represents the program processing of the computer main body section 35 in functional terms, however, the computer processing section can be configured by a hardware circuit composed of a combination of electronic circuits having capabilities imparted to the blocks shown in FIG. 5.

This embodiment is provided with six operational modes. The player can select from among first to sixth modes by operating a manual/automatic switch 61 and a mode switch 62 that are included in the setting operators 40*a*. The manual/automatic switch 61 is interlocked with the mode switch 62. When the manual/automatic switch 61 is set at "M" (manual) side, the mode switch 62 is connected to terminal "1" to enter the first mode. When the manual/automatic switch 61 is set at "A" (auto) side, on the other hand, the mode switch 62 is connected to one terminal selected from among terminals "2" to "6" to enter one of the second to sixth modes, respectively. Also interlocked with the mode switch 62 is a switch 62*a* which is set to "on" (high-level output) only when the mode switch 62 is connected to terminal "6".

(First Mode)

In the first mode, the manual/automatic switch 61 set at the "M" side brings an enable terminal of the memory device 36 into low-level, so that the memory device 36, a performance data reading processing section 51, and a fingering conversion processing section 52 are substantially turned into a state of not working, resulting in the operations of later-described automatic performance not being conducted. In addition, the manual/automatic switch 61 set at the "M" side brings a reverse input terminal of a gate circuit 63 into low-level, so that the gate circuit 63 is brought into conduction. As for a selector 64, when a selector terminal "B" is in high-level, input "B" is selected. In the first mode, therefore, the selector 64 selects input "A" to output signals. Further, respective operated states of the first to third valve operators based on the manual operation by a player are sensed by the switch circuit 32. The switch circuit 32 then outputs a valve state signal. The valve state signal comprises three bits, which correspond to the first to third valve operators, respectively, defining the operated state as "1" and the non-operated state as "0".

In the first mode, therefore, a valve state signal transmitted from the switch 32 is input to the light emission control circuit 37 via the gate circuit 63. The light emission control circuit 37 controls respective energization of the light-emitting elements 21 to 23 corresponding to the valve operators 11 to 13 in accordance with the respective bit contents of the valve state signal. The valve state signal transmitted from the switch 32 is also input to a tone pitch candidate extraction processing section 53 via the selector 64. The tone pitch candidate extraction processing section 53 is provided with a tone pitch candidate table 53*a*, which is made, for example, from the fingering view of FIG. 4. In the tone pitch candidate table 53*a*, the combinations of the valve operators ("–, 2, 3" etc.) shown in the left column of FIG. 4 are associated with the three bits of a valve state signal. The tone pitch candidate extraction processing section 53 then outputs, as sets of tone pitch candidate data, sets of tone pitch data on "determined tone pitch" shown in the bottom row corresponding to the symbol "o" provided for designated combinations. The sets of tone pitch candidate data output from the tone pitch candidate extraction processing section 53 are input to a tone pitch determination processing section 54.

On the other hand, a voice pitch of a voice signal that is input from the vibration sensor 20*a* is sensed by the pitch sensing circuit 31*a* and input to the tone pitch determination processing section 54. The tone pitch determination processing section 54 extracts a set of tone pitch data corresponding to the input voice pitch from among the sets of the input tone pitch candidate data and outputs the extracted tone pitch data to the first tone signal generating circuit 34*a*. On the extraction of the tone pitch data, the aforesaid allowance range set for the input voice pitch may be taken into account or may not be taken into account. Further, a tone volume level of the voice signal input from the vibration sensor 20*a* is sensed by the level sensing circuit 31*b* and input to a sounding control data generation processing section 55. The tone pitch data transmitted from the tone pitch determination processing section 54 is also output to a match sensing circuit 65 and a one-shot circuit 68 which will be described later, while the tone volume level transmitted from the level sensing circuit 31*b* is also output to a one-shot circuit 69, however, these circuits do not affect the operations in the first mode. The sounding control data generation processing section 55 extracts, from data on tone volume level, sounding control data such as a tone volume parameter (velocity) and a tone color parameter of a musical tone to be generated, and outputs the sounding control data to the first tone signal generating circuit 34*a*. The first tone signal generating circuit 34*a* then generates a tone signal (melody tone signal) on the basis of the tone pitch data determined at the tone pitch determination processing section 54 and the sounding control data to emit a musical tone via the amplifier 38 and speaker 30*a*.

In the first mode, as described above, a tone pitch of a musical tone to be generated is determined in accordance with the operated state of the valve operators 11 to 13 and the voice pitch transmitted from the vibration sensor 20*a* (oral input section 20), while a tone volume level is determined in accordance with the tone volume level (embouchure) transmitted from the vibration sensor 20*a*, thereby generating a musical tone having thus-determined tone pitch and tone volume. Therefore, the player can conduct manual performance (performance as an ordinary trumpet) on the electronic musical instrument. Further, the light-emitting elements 21 to 23 are energized in accordance with the operated state of the valve operators 11 to 13 in order to indicate an operated valve operator, allowing the player to confirm his/her performance operations.

(Second Mode)

The second mode is a preferred embodiment of the main point of the present invention. When the manual/automatic switch 61 goes into "A" (auto), the electronic musical instrument conducts automatic performance-related operations. When the manual/automatic switch 61 is in the "A" position, the mode switch 62 can select one of the terminals "2" to "6". When the terminal "2" is selected, the electronic musical instrument goes into the second mode. The switching of the mode switch 62 among the terminals "2" to "6" selects a signal to be output as an increment signal to the performance data reading processing section 51 in accordance with the mode.

The performance data reading processing section 51, the fingering conversion processing section 52 and a melody tone pitch mark sensing section 51*a* have capabilities of controlling the reading of automatic performance data from the memory device 36, the reading of melody data from the read-out automatic performance data and the stopping of the reading, the reading of one sequence of accompaniment data and the stopping of the reading, and the generation of valve state signals. As shown in FIG. 6, for example, automatic performance data includes melody tone pitch data representative of the tone pitch of a melody tone, melody note length data representative of the note length of the melody tone, accompaniment tone pitch data representative of the tone pitch of an accompaniment tone, and accompaniment note length data representative of the note length of the accompaniment tone. The above data is provided with a melody tone pitch mark, melody note length mark, accompaniment tone pitch mark and accompaniment note length mark, respectively. The performance data reading processing section 51 comprises memory for automatic performance and a reading section. When the manual/automatic switch 61 is in the "A" position, the performance data reading processing section 51 reads performance data from the memory device 36 and temporarily stores the read data in the memory for automatic performance, while reading melody tone pitch data.

The melody tone pitch data is then output to the fingering conversion processing section 52 and the later-described match sensing circuit 65. The fingering conversion processing section 52 automatically generates a valve state signal from the melody tone pitch data on the basis of a fingering table 52*a* and outputs the valve state signal to the light emission control circuit 37. Here, the fingering table 52*a* is equivalent to the inversely converted tone pitch candidate table 53*a*. The valve state signal is generated by converting a "determined tone pitch" (in this case, melody tone pitch data) shown in the bottom row in FIG. 4 into data in which a combination ("–, 2, 3" etc.) of "valve operators" corresponding to a symbol "o" of FIG. 4 is represented with three bits. That is, the valve state signal output from the fingering conversion processing section 52 is not the one sensed from an operated state of the valve operators 11 to 13 but is automatically generated on the basis of the melody tone pitch data contained in the automatic performance data. The light emission control circuit 37 controls, on the basis of the valve state signal, respective energization of the light-emitting elements 21 to 23 corresponding to the valve operators 11 to 13 and outputs the valve state signal to a shift register 66 which will be described later without processing.

When the melody tone pitch mark sensing section 51*a* senses a melody tone pitch mark of subsequent melody tone pitch data, the melody tone pitch mark sensing section 51*a* outputs a stop signal to the performance data reading processing section 51 to cause the performance data reading processing section 51 to temporarily stop the reading of melody tone pitch data. When the performance data reading processing section 51 receives an increment signal which will be described later, the performance data reading processing section 51 restarts the reading of subsequent melody tone pitch data. More specifically, the performance data reading processing section 51 and the melody tone pitch mark sensing section 51*a* behave such that they process a sequence of data corresponding to a set of melody tone pitch data including accompaniment-related data to increment the memory address of the memory for automatic performance. In other words, the performance data reading processing section 51 precedently reads a set of melody tone pitch data situated one set ahead.

Even if the performance data reading processing section 51 temporarily stops reading melody tone pitch data, by the internal automatic sequence processing, the performance data reading processing section 51 reads accompaniment tone pitch data and accompaniment note length data situated before the subsequent melody tone pitch data and outputs the read data to the second tone signal generating circuit 34*b* to generate a given accompaniment tone in accordance with the accompaniment note length data.

In the second mode, furthermore, since the manual/automatic switch 61 is in the "A" position, the gate circuit 63 is brought out of conduction, resulting in the selector 64 selecting input "B" to output a signal. To a selector terminal of a selector 67 there is connected a switch 62*a* which is interlocked with the connected terminal "6" of the mode switch 62. In the second mode, however, the mode switch 62 is connected to the terminal "2", resulting in low-level output of the switch 62*a*, so that the selector 67 selects input "B" to output a signal. The valve state signal from the light emission control circuit 37 is transmitted to the shift register 66 and output to the input "B" of the selector 67 via an OR circuit 66*a*. When the melody tone pitch data is read out, therefore, this valve state signal is instantaneously input to the tone pitch candidate extraction processing section 53 via the selectors 67 and 64.

As the above-described case, the tone pitch candidate extraction processing section 53 outputs sets of tone pitch candidate data corresponding to the valve state signal to the tone pitch determination processing section 54, while the voice pitch of the voice signal is sensed by the pitch sensing circuit 31*a* and input to the tone pitch determination processing section 54. As the above case, the tone pitch determination processing section 54 then extracts tone pitch data corresponding to the voice pitch from among the input tone pitch candidate data and outputs the extracted tone pitch data to the first tone signal generating circuit 34*a*. Further, tone volume level data contained in the voice signal is input via the level sensing circuit 31*b* to the sounding control data generation processing section 55. The sounding control data generation processing section 55 then outputs sounding control data to the first tone signal generating circuit 34*a*. A tone pitch is finally determined on the basis of the input voice pitch and tone pitch candidates. In accordance with the determined tone pitch, a tone signal for melody is generated by the first tone signal generating circuit 34*a* for melody.

In the second mode, the output of the match sensing circuit 65 is input via the terminal "2" of the mode switch 62 to the performance data reading processing section 51. If the melody tone pitch data output from the performance data reading processing section 51 matches with the tone pitch data determined by the tone pitch determination processing section 54, the match sensing circuit 65 outputs a match signal. The match signal is input to the performance data reading processing section 51 as an increment signal. That is, the valve state signal is automatically generated on the basis of melody tone pitch data contained in automatic performance data, and if a tone pitch selected, on the basis of a voice pitch input at the vibration sensor 20*a*, from among sets of tone pitch candidate data extracted according to the valve state signal matches with the melody tone pitch data, the performance data reading processing section 51 increments the memory address to read subsequent melody tone pitch data.

As described above, the valve state signal is instantaneously input to the tone pitch candidate extraction processing section 53 to bring about a state where it looks as if the valve state signal has been determined. At this state, the electronic musical instrument waits for an input from player's mouth transmitted from the vibration sensor 20*a*. Then, if the input voice pitch successfully matches with the melody tone pitch data, a match signal is output. The output match signal causes the increment of the memory address. If the voice pitch input at the vibration sensor 20*a* does not match with the melody tone pitch data, on the other hand, the match signal will not be output. After the electronic musical instrument enters a standby state to wait for an input from player's mouth transmitted from the vibration sensor 20*a*, and the input voice pitch matches with the melody tone pitch data (i.e., after the output of the match signal), the electronic musical instrument enters a state where a tone having the tone pitch should be kept generating.

Here, the increment caused by the above match signal replaces the valve state signal instantaneously input to the tone pitch candidate extraction processing section 53 at the reading of the melody tone pitch data with a valve state signal corresponding to subsequent melody tone pitch data. However, the preceding valve state signal is retained by the shift register 66. Since the shift register 66 is designed to shift by a stop signal, the valve state signal is still to be input to the tone pitch candidate extraction processing section 53. That is, even after the voice pitch matches with the melody tone pitch data, the tone pitch data corresponding to the voice pitch is to be output to the first tone signal generating circuit 34*a*, resulting in the generation of a tone having the pitch being maintained. Then, after a process for a note length of the melody tone pitch data is digested internally by the performance data reading processing section 51, a digesting signal is output. The digesting signal causes the shifting of the shift register 66, resulting in the valve state signal corresponding to the precedently-read melody tone pitch data being input to the tone pitch candidate extraction processing section 53. Then, these processes are similarly conducted on the subsequent melody tone pitch data.

As described above, in the second mode, a musical tone corresponding to an accompaniment tone is generated on the basis of automatic performance data. Further, on the basis of a valve state signal that is automatically generated from melody tone pitch data (that is not the one input through the operation of the valve operators 11 to 13), a combination of the valve operators 11 to 13 that should be operated in associated relation with melody tone pitch data is indicated through the energization of the light-emitting elements 21 to 23 in corresponding relation with the valve operators 11 to 13. Furthermore, when, on the basis of an automatically generated valve state signal and a voice pitch transmitted from the vibration sensor 20*a*, a tone pitch that matches with the melody tone pitch of the automatic performance data is determined, the electronic musical instrument proceeds with the performance of the melody.

(Third Mode)

In the third mode, in which the manual/automatic switch 61 is set at "A", operations for processing automatic performance data and operations for determining a tone pitch by the performance data reading processing section 51, fingering conversion processing section 52 and melody tone pitch mark sensing section 51*a* are conducted in the same manner as the second mode. In the third mode, the mode switch 62 is connected to the terminal "3" to input an output signal of the one-shot circuit 68 as an increment signal to the performance data reading processing section 51. When tone pitch data is output from the tone pitch determination processing section 54, the one-shot circuit 68 outputs a trigger signal, which acts as an increment signal for the performance data reading processing section 51. That is, after tone pitch data is determined on the basis of a voice pitch that is input from the vibration sensor 20*a* and a valve state signal that is automatically generated from melody tone pitch data, the electronic musical instrument carries on with the performance as in the case of the second mode.

As described above, the player is required more advanced performance operations in the third mode than in the second mode. More specifically, once some tone pitch is determined on the basis of a voice pitch from the vibration sensor 20*a* and the above-described automatically generated valve state signal, even if the tone pitch does not match with melody tone pitch data, the electronic musical instrument proceeds with the performance of the melody in the determined tone pitch (e.g., a harmonic overtone of the tone pitch of the melody). Even if a voice pitch which is different from melody tone pitch data is input erroneously, therefore, the melody is reproduced in the erroneous tone pitch.

As described above, allowance ranges of frequency drifts for voice signals indicated by arrows in FIG. 4 can be variously changed. In the third mode and fifth mode which will be described later, particularly, with the allowance ranges of frequency drifts for voice signals as indicated by arrows in FIG. 4, even if a player inputs a voice signal having any pitch to the oral input section 20, some tone signal is generated for tone pitches other than those indicated by arrows with a broken line. Therefore, for training in inputting a voice signal, it is preferable to narrow the arrows shown in FIG. 4. When a voice signal having a pitch deviated from a range shown by an arrow is input to the oral input section 20, the narrowed arrows prevent the tone pitch determination processing section 54 from outputting tone pitch data. As a result, the one-shot circuit 68 does not output an increment signal to the performance data reading processing section 51, so that subsequent performance data will not be read out, and the performance is suspended.

The above means that the tone pitch determination processing section. 54 which acts as a tone pitch determination section for determining a tone pitch has determined not to generate a tone signal on the basis of the relation between the voice pitch from the pitch sensing circuit 31*a* and the tone pitch candidates from the tone pitch candidate extraction processing section 53. In other words, it means that the above-input voice pitch is inappropriate for the combination of the valve operators 11 to 13 generated by the fingering conversion processing section 52 on the basis of the performance data that is read out by the performance data reading processing section 51. In this case, any tone signal will not be generated, while the performance data reading processing section 51 will not increment the memory address. Therefore, the allowance ranges with narrowed arrows are effective at player's training in inputting a voice signal having an appropriate pitch to the oral input section 20. Narrowing the allowance ranges of frequency drifts of voice signals to the width narrower than those indicated by the arrows in FIG. 4 can be applicable to other modes.

(Fourth Mode)

In the fourth mode as well, the above-described operations for processing automatic performance data and operations for determining a tone pitch are conducted in the same manner as the second and third modes. In the fourth mode, the mode switch 62 is connected to the terminal "4" to input an output signal of a second one-shot circuit 69 to the performance data reading processing section 51 as an increment signal. To the one-shot circuit 69 a tone volume level signal that is output from the level sensing circuit 31*b* is input. When the tone volume level signal is equal to or above a given threshold level, the one-shot circuit 69 outputs a trigger signal, which acts as an increment signal for the performance data reading processing section 51. In other words, when the voice volume (or breath level) that is input from the vibration sensor 20*a* is equal to or above a given level, the electronic musical instrument carries on with the performance of the music as in the case of the second mode.

In the fourth mode, as described above, requirements imposed on the player to proceed with the performance are relaxed compared to the second mode. If the voice volume (breath level) sensed by the vibration sensor 20*a* is equal to or above a given level (threshold level), the electronic musical instrument carries on with the automatic performance even if any voice pitch has not been sensed (of course, the electronic musical instrument carries on with the performance when a voice pitch is sensed). In the fourth mode, when only a breath tone is input, for example, the progress of the automatic performance is controlled only by performance timing, and the electronic musical instrument carries on with the performance of accompaniment tones based on the automatic performance data read out from the memory device 36 without the melody tones. In this case, if melody tone pitch data is generated from the tone pitch determination processing section 54 on the basis of tone pitch information contained in the breath tone, the electronic musical instrument proceeds with the performance with a melody tone added.

(Fifth mode)

In the fifth mode as well, the above-described operations for processing automatic performance data and operations for determining a tone pitch are conducted in the same manner as the second to fourth modes. In the fifth mode, the mode switch 62 is connected to the terminal "5" to input trigger signals of the one-shot circuit 68 and the second one-shot signal circuit 69 via an AND circuit 71 as increment signals to the performance data reading processing section 51. In the fifth mode, more specifically, when some tone pitch (e.g., a harmonic overtone of a melody tone pitch) is determined on the basis of a voice pitch and an automatically generated valve state signal (as the case of the third mode), and the tone volume (breath level) is equal to or above a given level (as the case of the fourth mode), the electronic musical instrument carries on with the performance of the melody tones. In cases where the memory device 36 contains accompaniment data for automatic performance, the electronic musical instrument proceeds with the performance of the melody tones along with the performance of the accompaniment tones.

(Sixth Mode)

In the sixth mode, the operations for processing automatic performance data are conducted in the same manner as the second to fourth modes, however, the operations for determining a tone pitch are conducted in the same manner as the first mode. In the sixth mode, the mode switch 62 is connected to the terminal "6" to input a match signal of the match sensing circuit 65 as an increment signal for the performance data reading processing section 51 as in the case of the second mode. In this mode, however, the switch 62*a* that is interlocked with the connected terminal "6" of the mode switch 62 is set to "on" with high-level output, so that the selector 67 selects the input "A" to output a signal. The selector 64 selects the input "B" to output a signal as in the cases of the second to fifth modes, so that the valve state signal output from the switch circuit 32 is input to the tone pitch candidate extraction processing section 53 (same as the first mode).

In the sixth mode, consequently, when the tone pitch determined on the basis of the voice pitch transmitted from the vibration sensor 20*a* and the valve state signal derived from the performance operation on the valve operators 11 to 13 (not the one automatically generated from melody tone pitch data) matches with melody tone pitch data contained in automatic performance data, the electronic musical instrument proceeds with the melody performance.

The threshold for sensing the tone volume level at the level sensing circuit 31*b* may be adapted to be adjustable by use of a variable resistor 31*c*. The introduction of the variable resistor 31*c* enables the player to appropriately set a breath level in the fourth and fifth modes in order to allow the electronic musical instrument to proceed with the performance.

The above-described embodiment is designed such that an instruction to stop the performance made after the increment of the memory address is given at the detection of subsequent melody tone pitch data (or melody tone pitch mark), however, the above embodiment may be adapted to give the instruction to stop the performance after the detection of subsequent timing data (time) or note length data (time interval), or the detection of a mark thereof. Besides note data such as subsequent melody tone pitch data, the instruction may by given at every given length of performance (or a length determined on the basis of some rule) divided by the unit of phrase, bar, etc. or at every rest. That is, the intervals between the increment and suspension of the performance in the present invention are not necessarily divided by the unit of a note such as the case of the above-described embodiment, but may be divided by the above-described units. Furthermore, the intervals may be divided by other units. In addition, it is needless to say that the format of performance data that is applicable to the present invention is not limited to the one employed in the embodiment (FIG. 6) but may be other different formats.

Further, in the above-described embodiment, the operators to be operated among the first to third valve operators 11 to 13 are visually displayed by energization of the light-emitting elements 21 to 23. However, instead of this or in addition to this, the valve operators to be operated may be a little displaced upwards or downwards, or the valve operators may be vibrated so as to give fingering guide such that the valve operators to be operated may be recognized by the player through his/her skin sensation. In this case, as shown by broken lines in FIG. 2, driving devices 81 to 83 such as a small electromagnetic actuator or a small piezoelectric actuator that drive the first to third valve operators 11 to 13 may be incorporated in the grasping section 50 and, instead of or in addition to the light emission control circuit 37, a driving control circuit may be disposed that controls driving of the aforesaid driving devices 81 to 83 on the basis of the valve state signal representing the valve operators to be operated.

Shown in the above embodiment is an example in which the configuration for inputting automatic performance data from the memory device 36 is adopted as "ancillary performance section" or "automatic performance section" for inputting performance data, however, the "ancillary performance section" is not limited to this example. For instance, performance data performed by a professional player or skilled player may be input to the "ancillary performance section". Alternatively, the "ancillary performance section" may receive performance data from a server on the Internet.

Furthermore, described in the above embodiment is a case of a trumpet-shaped musical instrument, however, the present invention may be applied to wind instrument-shaped electronic musical instruments which imitate a wind instrument which has a plurality of performance operators and determines a tone pitch of a musical tone to be generated on the basis of a combination of operated performance operators.

Further, described in the above embodiment is a case where a vibration sensor such as a microphone is used as means for inputting a voice pitch, however, a bone conduction pick-up device that senses vibration by being allowed to touch the "throat" of a human body may be used. By use of such device, the present invention paves the way to enable those having bad vocal cords to play a mouth air stream type musical instrument.

What is claimed is:

1. A musical instrument having a plurality of performance operators and an oral input section for inputting a signal containing a pitch generated by a user's mouth, the musical instrument comprising:

an ancillary performance section for sequentially outputting first performance data representative of a tone pitch of a musical tone;

a combination information producing section for automatically producing, on the basis of the first performance data sequentially output from the ancillary performance section, combination information corresponding to a combination of the plurality of performance operators that represents a tone pitch represented by the first performance data;

a pitch information sensing section for sensing pitch information on a pitch on the basis of a signal input to the oral input section; and a tone pitch determination section for determining in one playing mode a tone pitch of a musical tone to be generated solely on the basis of the automatically produced combination information, which is automatically produced based on the first performance data, and the sensed pitch information.

2. A musical instrument according to claim 1, wherein the plurality of performance operators are adapted for operation with a user's hand.

3. A musical instrument according to claim 1, wherein the musical instrument has a shape of a wind instrument.

4. A musical instrument according to claim 1, further comprising a musical tone generating section for generating a musical tone having the determined tone pitch.

5. A musical instrument according to claim 1, further comprising a performance data output control section for determining whether the tone pitch determined by the tone pitch determination section matches the tone pitch represented by the first performance data output from the ancillary performance section, and controlling, when a match is determined, the ancillary performance section so that the ancillary performance section outputs succeeding first performance data.

6. A musical instrument according to claim 1, wherein:

the tone pitch determination section determines on the basis of a relation between the automatically produced combination information and the sensed pitch information whether a musical tone corresponding to a signal input to the oral input section should be generated; and the musical instrument further comprises a performance data output control section for controlling, only when the tone pitch determination section determines that the musical tone should be generated, the ancillary performance section so that the ancillary performance section outputs succeeding first performance data.

7. A musical instrument according to claim 1, further comprising a performance data output control section for controlling, when a level of a signal input to the oral input section is equal to or above a given level, the ancillary performance section so that the ancillary performance section outputs succeeding first performance data.

8. A musical instrument according to claim 1, wherein:

the tone pitch determination section determines on the basis of a relation between the automatically produced combination information and the sensed pitch information whether a musical tone corresponding to a signal input to the oral input section should be generated; and the musical instrument further comprises:

a level determination section for determining whether a level of a signal input from the oral input section is equal to or above a given level; and a performance data output control section for controlling, when the tone pitch determination section determines that the musical tone should be generated, and the level determination section determines that the level of the signal input from the oral input section is equal to or above the given level, the ancillary performance section so that the ancillary performance section outputs succeeding first performance data.

9. A musical instrument according to claim 1, wherein the ancillary performance section outputs second performance data that is different from the first performance data in interlocked relation with the first performance data and generates a musical tone corresponding to the second performance data.

10. A musical instrument according to claim 9, wherein the first performance data represents a melody tone, while the second performance data represents an accompaniment tone.

11. A musical instrument according to claim 1, further comprising a performance guiding section for showing a user a combination of the plurality of performance operators to be operated based on performance data output from the ancillary performance section.

12. A musical instrument according to claim 11, wherein the performance guiding section includes a plurality of light emitting devices for displaying the performance operators to be operated by light emission of a neighborhood of each of the plurality of performance operators.

13. A musical instrument having a plurality of performance operators and a oral input section for inputting a signal containing a pitch generated by a user's mouth, the musical instrument comprising:

an ancillary performance section for sequentially outputting first performance data representative of a tone pitch of a musical tone;

a pitch information sensing section for sensing pitch information on a pitch on the basis of a signal input to the oral input section;

a tone pitch determination section for determining a tone pitch of a musical tone to be generated on the basis of a combination of operated performance operators among the plurality of performance operators and the sensed pitch information; and a performance data output control section for controlling, on the basis of the tone pitch determined by the tone pitch determination section and the tone pitch represented by the first performance data output from the ancillary performance section, the ancillary performance section so that the ancillary performance section outputs succeeding first performance data, wherein the performance data output control section determines whether the tone pitch determined by the tone pitch determination section matches the tone pitch represented by the first performance data output from the ancillary performance section, and controls the ancillary performance section so that the ancillary performance section outputs succeeding first performance data only when a match is determined.

14. A musical instrument according to claim 13, wherein the musical instrument has a shape of a wind instrument.

15. A musical instrument according to claim 13, further comprising a performance guiding section for showing a user a combination of the plurality of performance operators to be operated based on first performance data output from the ancillary performance section.

16. A musical instrument according to claim 15, wherein the performance guiding section includes a plurality of light emitting devices for displaying the performance operators to be operated by light emission of a neighborhood of each of the plurality of performance operators.

17. A musical instrument according to claim 13, wherein the ancillary performance section outputs second performance data that is different from the first performance data in interlocked relation with the first performance data and generates a musical tone corresponding to the second performance data.

18. A musical instrument according to claim 17, wherein the first performance data represents a melody tone, while the second performance data represents an accompaniment tone.

19. A musical instrument comprising:

an oral input section for inputting a signal generated by a user's mouth, wherein the signal input from the oral input section has a pitch;

a plurality of performance operators;

a storage section for storing first performance data representative of an accompaniment tone appropriate to a melody tone;

a level sensing section for sensing a level of a signal input from the oral input section and outputting a trigger signal when the sensed level is equal to or above a given level;

a reading processing section for reading the first performance data from the storage section only when the trigger signal is output;

a first musical tone generating section for generating the accompaniment tone on the basis of the first performance data read out by the reading processing section;

a pitch information sensing section for sensing pitch information on a pitch on the basis of a signal input to the oral input section;

a tone pitch determination section for determining, on the basis of the sensed pitch information and combination information representative of a combination of the plurality of performance operators, a tone pitch of a musical tone to be generated; and a second musical tone generating section for generating a musical tone having the determined tone pitch.

20. A musical instrument according to claim 19, wherein:

the storage section further stores second performance data representative of the melody tone;

the reading processing section outputs the second performance data in interlocked relation with the first performance data; and the combination information is automatically produced on the basis of the second performance data.

21. A musical instrument according to claim 19, wherein the second musical tone generating section generates a musical tone having the determined tone pitch in a tone volume level corresponding to the level of the signal sensed by the level sensing section.

22. A musical instrument according to claim 19, wherein the musical instrument has a shape of a wind instrument.

23. A method of generating a musical tone in a musical instrument having a plurality of performance operators and an oral input section for inputting a signal containing a pitch generated by a user's mouth, the method including the steps of:

reading performance data representative of a tone pitch of a musical tone from a storage section and outputting the read performance data;

automatically producing, on the basis of the output performance data, combination information corresponding to a combination of the plurality of performance operators that represents the tone pitch represented by the performance data;

sensing pitch information on a pitch on the basis of a signal input to the oral input section; and generating a musical tone having a tone pitch determined in one playing mode solely on the basis of the automatically produced combination information, which is automatically produced based on the output performance data, and the sensed pitch information.

24. A method of generating a musical tone in a musical instrument having a plurality of performance operators and an oral input section for inputting a signal containing a pitch generated by a user's mouth, the method including the steps of:

reading performance data representative of a tone pitch of a musical tone from a storage section and outputting the read performance data;

sensing pitch information on a pitch on the basis of a signal input to the oral input section;

determining a tone pitch of a musical tone to be generated on the basis of a combination of an operated performance operator among the plurality of performance operators and the sensed pitch information; and determining, on the basis of the determined tone pitch and the tone pitch represented by the output performance data, whether to output succeeding performance data from the storage section, and outputting the succeeding performance data only when the determined tone pitch matches the tone pitch represented by the read performance data.

25. A method of claim 24, further including the steps of:

sensing a level of a signal input to the oral input section, and outputting, when the sensed level is equal to or above a given level, a trigger signal;

reading, only when the trigger signal is output, performance data representative of an accompaniment tone appropriate to a melody tone from a storage section; and generating the accompaniment tone on the basis of the read performance data.

* * * * *